US005104558A

United States Patent [19]

Matsuzaki

[11] Patent Number: 5,104,558

[45] Date of Patent: Apr. 14, 1992

[54] RUST-PROOFING OIL COMPOSITION

[75] Inventor: Yukio Matsuzaki, Hadano, Japan

[73] Assignee: Nippon Oil Co., Ltd., Tokyo, Japan

[21] Appl. No.: 577,011

[22] Filed: Sep. 4, 1990

Related U.S. Application Data

[63] Continuation-in-part of Ser. No. 457,381, Dec. 27, 1989, abandoned.

[30] Foreign Application Priority Data

Dec. 27, 1988 [JP] Japan ..... 63-330687
Apr. 3, 1989 [JP] Japan ..... 1-84262

[51] Int. Cl.[5] ..... C10M 141/02

[52] U.S. Cl. ..... 252/33.2; 252/33.4; 252/48.6

[58] Field of Search ..... 252/17, 33.2, 42, 48.6, 252/33.4

[56] References Cited

U.S. PATENT DOCUMENTS

| | | | |
|---|---|---|---|
| 2,947,599 | 8/1960 | Ennis | 252/48.6 |
| 4,380,498 | 4/1983 | Kammann, Jr. et al. | 252/48.6 |
| 4,842,752 | 6/1989 | Hardy et al. | 252/17 |
| 4,957,651 | 9/1990 | Schwind | 252/48.2 |
| 4,978,465 | 12/1990 | Sturwold | 252/48.6 |

*Primary Examiner*—Jacqueline Howard
*Attorney, Agent, or Firm*—Bucknam and Archer

[57] ABSTRACT

A rust-proofing oil composition is disclosed for use in the surface treatment of steel sheets which are plated with zinc and other plate materials. The composition includes a base oil such as a mineral and/or synthetic oil having a kinematic viscosity of 5–50 cSt at 40° C. and blended in specified combinations with ester sulfide, metallic soap and metallic sulfonate. The composition exhibits ability of eliminating flaking, scoring and other surface defects of a plated steel sheet.

18 Claims, No Drawings

RUST-PROOFING OIL COMPOSITION

This is a continuation-in-part of U.S. Ser. No. 07/457,381 filed Dec. 27, 1989, now abandoned.

BACKGROUND OF THE INVENTION

Field of the Invention

This invention relates generally to an oil composition and more particularly to a rust-proofing oil composition for use in the surface treatment of metallic substrates.

Prior Art

There has recently been an increasing demand for surface-treated metal sheets such as a steel sheet plated with zinc, lead, tin, chromium, nickel, aluminum and their alloys, such surface-treated steel sheet having an anticorrosion property far excelling an untreated counterpart. Surface-treated steel sheets are generally molded and coated to give a line of final products. When molded as by press, sheet metal working or drawing, the steel sheet is susceptible to powdering, flaking, scoring and other surface defects.

The problems of such surface defects or damage are expounded extensively in technical journals such as for example "J. Plastics Processing Society of Japan", Vol. 24, No. 275, 1248–1250 (1983) and "J. Plastics and Their Fabrication", Vol. 26, No. 291, 416–423 (1985), in which the surface defects of plated articles are broadly classified into powdering, flaking and scoring. By powdering is meant a phenomenon in which a plated surface layer is powdered or pulverized and separated from the metal matrix during molding. Flaking is defined by the development of macroscopic flakes of plated surface separated from the matrix during molding. Scoring denotes a phenomenon in which foreign matters deposited on working tools rake up and crack the plated surface layer. Powdering occurs mainly due to the fact that surface plated layers are less ductile than a matrix material and hence cannot follow with deformation of the matrix. This problem can hardly be solved by the use of lubricants.

However, it is emperically proven that flaking and scoring can be eliminated or alleviated by the use of suitable lubricating oils.

At any rate, the above-noted surface defects would result not only in reduced corrosion-resistance intrinsic of surface-treated steel sheet products but also in scores or damage in the surface of a steel product that are difficult to repair, and would furthermore lead to deteriorated coating and hence reduced commercial value of the product.

To prevent the development of the surface defects in question, those who mold or otherwise finish surface-treated steel products would often apply high quality lubricants to the steel surface beforehand. This lubricant application however is rather tedious and involves the problem of degreasing afterwards.

It is also possible, as disclosed in Japanese Laid-Open Patent Publication No. 61-26695, to deal with "surface defects" by adding a wax to a rust-proofing oil applied to the surface-treated steel products prior to delivery from the supplier. This approach likewise involves extremely difficult degreasing of the resulting wax film. Another alternative has been proposed to coat the treated steel sheet with a thin organic polymer, but this is objectionably costly.

SUMMARY OF THE INVENTION

It is therefore the primary object of the present invention to provide a novel rust-proofing oil composition which exhibits, in addition to satisfactory rust-proofing, an excellent ability of eliminating surface defects such as flaking and scoring of surface-treated steel products.

More specifically, the invention provides a rust-proofing oil composition which is capable of completely preventing rust formation during the period between the time of shipment from the site of surface-treated steel sheet production and the time of its use, also completely eliminating surface defects which may develop in the plated surface layer of treated steel sheet and further degreasing subsequent to product finishing with greater ease.

According to the invention, there is provided a rust-proofing oil composition which comprises a mineral oil and/or a synthetic oil as a base oil having a kinematic viscosity at 40° C. in the range of 5–50 cSt, an ester sulfide in an amount of 2–15 parts by weight per 100 parts by weight of the base oil and a metallic soap in an amount of 2–15 parts by weight per 100 parts by weight of the base oil.

The above objects and other features of the invention will appear more apparent from the following detailed description.

DETAILED DESCRIPTION OF THE INVENTION

A rust-proofing oil composition contemplated under the present invention is comprised essentially of a base oil, an ester sulfide and either one or both of a metallic soap and a metallic sulfonate.

The term "mineral oil" hereinafter referred to is a blend of such oils as those vacuum-distilled, solvent-deasphalted, solvent-extracted, hydrogenation-decomposed, solvent-dewaxed, hydrogenation-dewaxed, sulfuric acid-washed, clay-refined and hydrogenation-refined. Specific examples include SAE 10, SAE 20, SAE 30, SAE 40, SAE 50 and bright stock.

The term "synthetic oil" designates polybutenes, α-olefin oligomers, alkylbenzenes, alkylnaphthalenes, diesters, polyol esters, polyglycols, polyphenyl ethers, tricresyl phosphates, silicone oils, perfluoroalkyl ethers, normal paraffins, isoparaffins and the like.

The term "base oil" represents mineral oils and/or synthetic oils of the class above named and has a kinematic viscosity of 5–50 cSt, preferably 5–20 cSt at 40° C. Less viscosities than 5 cSt would result in loss by evaporation of the oil coated on steel and stored for extended length of time and hence in reduced effect of rust-proofing and surface defects elimination. Conversely, kinematic viscosities exceeding 50 cSt would lead to unsatisfactory degreasing after molding.

The term "ester sulfide" designates a reaction product resulting from reacting at elevated temperature a carboxylic acid ester having one or more unsaturated bonds per molecule with a sulfur compound such as sulfur, sulfur monochloride, sulfur dichloride or mercaptan. As carboxylic acid esters there may be used alkyl esters of 1–20 carbon atoms such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, noandecyl, eicosyl esters and the like, which esters are derived from unsaturated fatty acids having 3–20 carbon atoms and selected from acrylic acid, propionic acid methacrylic acid, crotonic acid, isocrotonic acid, oleic acid, eraidic acid, ricinoleic acid, linoleic acid, linolenic acid and the like. Also included in good replacements are animal fats and oils such as fish oil, tallow, lard, sperm oil and the like and vegetable fats and oils such as tall oil, linseed oil, olive oil, soybean oil, rapeseed oil, castor oil, peanut oil, rice bran oil and the like.

Details of the production of these ester sulfides are disclosed for example in Japanese Laid-Open Patent Publication No. 59-159896.

The amount of the ester sulfide to be added is 2–15 parts by weight, preferably 5–10 parts by weight per 100 parts by weight of the base oil. Less than 2 parts would be ineffective, and more than 15 parts would be only economically infeasible.

The term "metallic soap" includes metallic salts of fatty acids such as palmitic acid, stearic acid, oleic acid and the like, naphthenic acids, resin acids, lanolin fatty acids, paraffin oxides, alkenylsuccinic acids, amino acids and similar acids. Suitable metals may be selected for example from alkali metals such as lithium, sodium, potassium and the like, alkaline earth metals such as magnesium, calcium, barium and the like and other types of metals such as aluminum, zinc, lead and the like. Particularly preferred are metallic salts of paraffin oxides, examples of which oxides are those obtained by air-oxidizing petroleum waxes such as paraffin wax, microcrystalline wax and the like and synthetic waxes such as polyethylene wax and the like. These paraffin oxide-derived salts have an acid value of from 2 to 30, preferably from 12 to 20, and a saponification of from 10 to 140, preferably from 50 to 80. The amount of the metallic soaps to be used is from 2 to 15 parts by weight, preferably from 5 to 10 parts by weight per 100 parts by weight of the base oil. Less than 2 parts would bear no effective results, while more than 15 parts would be only economically infeasible.

The term "metallic sulfonate" includes metallic salts derived from sulfonic acids of a mineral or synthetic class such as petroleum sulfonic acid, dinonylnaphthalene sulfonic acid, alkylbenzene sulfonic acid and the like. Examples of metals include alkali metals such as lithium, sodium, potassium and the like, alkaline earth metals such as magnesium, calcium, barium and the like and other metals such as zinc and the like. These metallic sulfonates are neutral, basic or overbasic in nature. They range in amount from 2 to 15 parts by weight, preferably from 3 to 10 parts by weight per 100 parts by weight of the base oil. Less than 2 parts would be ineffective, and more than 15 parts would produce no better results.

The composition of the invention is for itself effective both in rust-proofing and "serface defects" prevention, but may be added, if desired, with known additives such as for example antioxidants, viscosity index improvers, pour point reducers, oilness improvers, extreme pressure additives, corrosion inhibitors, rust preventives and the like.

The inventive composition finds application to various surface-treated sheets of steel such as for example cold- or hot-rolled steel plated with zinc, lead, tin, chromium, nickel, aluminum and their alloys. Particularly suitable is a so-called, zinc-plated steel obtained by electroplating a hot- or cold-rolled steel or by fusion with zinc, zinc-iron alloy, zinc-nickel alloy, zinc-aluminum alloy and the like, or alternatively by thermally treating a zinc-plated or zinc alloy-plated steel.

The invention will be further described by way of the following examples.

Inventive Examples 1–14 and Comparative Examples 1–11

The compositions for these examples are tabulated below along with their test results.

Mineral Base Oil

Paraffinic refined oils derived from a lubricant fraction produced by distillation of Middle East crude oil with the fraction being furfural-treated, hydrogen-refined and MEK-dewaxed M-A : Kinematic viscosity at 40° C., 6.54 cSt
M-B : Kinematic viscosity at 40° C., 48.8 cSt
M-C Kinematic viscosity at 40° C., 85.3 cSt

Synthetic Base Oil

S-A Branched alkylbenzene mixture produced by benzene alkylation of propylene polymer with hydrofluoric acid catalyst and 15.8 cSt at 40° C. in kinematic viscosity S-B: Poly-α-olefin, Kinematic viscosity at 40° C., 18.1 cSt S-C: Polyester, Kinematic viscosity at 40° C., 19.9 cSt

Ester Sulfide

A: Lard sulfide
B: Vegetable oil ester sulfide
C: Rice bran methyl ester sulfide

Metallic Soap

A: Barium soap of paraffin oxide
B: Sodium soap of paraffin oxide
C: Barium soap of lanolin fatty acid

Metallic Sulfonate

A: Barium soap of mineral oil-based sulfonic acid (neutral)
B: Calcium salt of alkylbenzene sulfonic acid (basic)
C: Sodium salt of dinonyl naphthalene sulfonic acid

Surface-treated Steel Sheet

A: Steel sheet electro plated on both sides with 30 $g/m^2$ zinc

B: Steel sheet plated by fusion on one side with 45 $g/m^2$ zinc and thermally treated to give alloyed zinc-plated sheet

Test for Surface Defects Prevention

A test piece of each of the surface-treated steel sheets was coated with the compositions in the Examples and subjected to bead drawing to determine occurence of flaking and scoring. Test results were rated on the basis of zero (0) representing a surface defects condition of a test piece coated with a non-additive oil composition having mineral oils A and B of 15.4 cSt at 40° C. blended at a ratio of 50/50 percent by weight. The value of 10 represents a complete freedom of surface defects.

Rust-proofing Test by Saline Solution Spray

The procedure pursuant to JIS K 2246 was followed. Test results were rated stepwise from A to E, where A represents freedom of rust and E represents rust generation on total surface.

Degreasability Test

A commercially available degreasing agent was used. Test results were rated with an "○" representing satisfactory degreasability, with an "X" mark for bad and with a "Δ" mark for medium.

It will be understood from Table 1 that the compositions in Inventive Examples 1–6 are all satisfactory in respect of surface defects-preventing, rust-proofing and degreasing properties and that those in Inventive Examples 7–14 exhibit more effective rust-proofing performance. The compositions in Inventive Examples 12 and 14 are lower in degreasability somewhat but not to an extent to rule out commercial use.

Whereas, the compositions in Comparative Examples 1, 2 and 9 blended with ester sulfide alone are inferior to those of the invention in terms of surface defects prevention and show totally no rust-proofing ability. The compositions in Comparative Examples 3–6 blended solely with metallic soap or metallic sulfonate have somewhat improved rust-proofing effect but show substantially no ability for surface defects prevention. The compositions in Comparative Examples 7, 8 and 10 blend with both metallic soap and metallic sulfonate but with no ester sulfide show better rust-proofing effect but substantially no ability for surface defects prevention. The composition in Comparative Example 11 blended with all of ester sulfide, metallic soap and metallic sulfonate and having a base oil viscosity departing from the inventive range has little degreasing ability.

TABLE 1

| run | base oil (100 parts) type | base oil cSt, 40° C. | ester sulfide type | ester sulfide part | metallic soap type | metallic soap part | metallic sulfonate type | metallic sulfonate part | surface defect prevention flaking | surface defect prevention scoring | rust proofness (hr) 6 | 12 | 18 | 24 | dewaxability | steel sheet type |
|---|---|---|---|---|---|---|---|---|---|---|---|---|---|---|---|---|
| Example 1 | M-A 50% M-B 50% | 15.4 | A | 3 | — | — | B | 4 | 7 | 7 | A | C | E | | ○ | A |
| Example 2 | M-A 50% M-B 50% | " | C | 5 | — | — | C | 2 | 7 | 7 | A | E | | | ○ | A |
| Example 3 | M-A 50% M-B 50% | " | B | 7 | — | — | A | 3 | 9 | 7 | A | E | | | ○ | B |
| Example 4 | M-A 50% M-B 50% | " | B | 5 | A | 5 | — | — | 6 | 7 | A | C | E | | ○ | A |
| Example 5 | M-A 50% M-B 50% | " | A | 5 | C | 2 | — | — | 7 | 7 | A | E | | | ○ | B |
| Example 6 | M-A 50% M-B 50% | " | C | 3 | A | 4 | — | — | 7 | 7 | A | D | E | | ○ | A |
| Example 7 | M-A 50% M-B 50% | " | B | 4 | B | 3 | B | 3 | 8 | 9 | A | A | E | | ○ | B |
| Example 8 | M-A 50% M-B 50% | " | B | 10 | A | 5 | C | 5 | 9 | 9 | A | A | D | E | ○ | A |
| Example 9 | M-A 50% M-B 50% | " | C | 5 | B | 5 | A | 11 | 9 | 9 | A | A | A | C | ○ | A |
| Example 10 | M-A | 6.54 | A | 5 | B | 10 | B | 5 | 8 | 8 | A | A | A | A | ○ | A |
| Example 11 | M-B | 48.8 | A | 5 | A | 5 | B | 5 | 7 | 8 | A | A | B | E | ○ | A |
| Example 12 | S-A | 15.8 | B | 5 | C | 5 | A | 5 | 8 | 8 | A | A | A | D | Δ | B |
| Example 13 | S-B | 18.1 | C | 5 | A | 7 | B | 7 | 9 | 9 | A | A | A | A | ○ | A |
| Example 14 | S-C | 19.9 | A | 7 | A | 5 | B | 5 | 9 | 8 | A | A | B | D | Δ | A |

TABLE 2

| run | base oil (100 parts) type | base oil cSt, 40° C. | ester sulfide type | ester sulfide part | metallic soap type | metallic soap part | metallic sulfonate type | metallic sulfonate part | surface defect prevention flaking | surface defect prevention scoring | rust proofness (hr) 6 | 12 | 18 | 24 | dewaxability | steel sheet type |
|---|---|---|---|---|---|---|---|---|---|---|---|---|---|---|---|---|
| Comparative Example 1 | M-A 50% M-B 50% | 15.4 | A | 7 | — | — | — | — | 4 | 4 | E | | | | ○ | A |
| Comparative Example 2 | M-A 50% M-B 50% | " | B | 10 | — | — | — | — | 4 | 3 | E | | | | ○ | A |
| Comparative Example 3 | M-A 50% M-B 50% | " | — | — | B | 7 | — | — | 1 | 1 | A | E | | | ○ | A |
| Comparative Example 4 | M-A 50% M-B 50% | " | — | — | A | 10 | — | — | 1 | 1 | A | E | | | Δ | A |
| Comparative Example 5 | M-A 50% M-B 50% | " | — | — | — | — | A | 7 | 1 | 1 | A | E | | | ○ | A |
| Comparative Example 6 | M-A 50% M-B 50% | " | — | — | — | — | C | 7 | 1 | 0 | A | E | | | ○ | A |
| Comparative Example 7 | M-A 50% M-B 50% | " | — | — | B | 7 | A | 7 | 1 | 1 | A | B | E | | ○ | A |
| Comparative Example 8 | M-A 50% M-B 50% | " | — | — | C | 5 | C | 10 | 1 | 1 | A | A | C | E | Δ | A |
| Comparative Example 9 | S-C | 19.9 | C | 7 | — | — | — | — | 4 | 4 | E | | | | ○ | A |
| Comparative Example 10 | " | 19.9 | — | — | C | 5 | A | 5 | 1 | 2 | A | C | E | | Δ | A |
| Comparative Example 11 | M-C | 85.3 | B | 5 | B | 5 | B | 5 | 8 | 8 | A | A | E | | X | A |

What is claimed is:

1. A rust-proofing oil composition for use in the surface treatment of steel sheets comprising at least one of a mineral oil and a synthetic oil as a base oil having a kinematic viscosity at 40° C. in the range of 5–50 cSt, A) at least one of an ester sulfide and a fat sulfide in an amount of 2–15 parts by weight per 100 parts by weight of said base oil;

B) and a metallic soap of at least one of a lanolin fatty acid and a metallic salt of a paraffin oxide in an amount of 2–15 parts by weight per 100 parts by weight of said base oil.

2. A rust-proofing oil composition as claimed in claim 1 wherein said steel sheet is a zinc-plated steel sheet.

3. A rust-proofing oil composition as claimed in claim 1 wherein said mineral oil is selected from the group consisting of SAE 10, SAE 20, SAE 30, SAE 40, SAE 50 and bright stock.

4. A rust-proofing oil composition as claimed in claim 1 wherein said synthetic oil is selected from the group consisting of polybutene, α-olefin oligomer, alkylbenzene, alkylnaphthalene, diester, polyol ester, polyglycol, polyphenyl ether, tricresyl phosphate, silicone oil, perfluoroalkyl ether, normal paraffin and isoparaffin.

5. A rust-proofing oil composition as claimed in claim 1 wherein said ester sulfide or fat sulfide is a reaction product resulting from reacting an ester of a carboxylic acid or a fat with a sulfur compound.

6. A rust-proofing oil composition as claimed in claim 5 wherein said carboxylic acid is selected from the group consisting of acrylic acid, propionic acid, methacrylic acid, crotonic acid, isocrotonic acid, oleic acid, eraidic acid, ricinoleic acid, linoleic acid and linolenic acid.

7. A rust-proofing oil composition as claimed in claim 5 wherein said ester is selected from the group consisting of methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, noandecyl and eicosyl esters.

8. A rust-proofing oil composition as claimed in claim 5 wherein said fat is selected from the group consisting of fish oil, tallow, lard, sperm oil, tall oil, linseed oil, olive oil, soybean oil, rapeseed oil, castor oil, peanut oil and rice bran oil.

9. A rust-proofing oil composition as claimed in claim 5 wherein said sulfur compound is selected from the group consisting of sulfur, sulfur monochloride, sulfur dichloride and mercaptan.

10. A rust-proofing oil composition as claimed in claim 1 wherein said metallic salt has an acid value in the range of 2–30.

11. A rust-proofing oil composition as claimed in claim 1 wherein said metallic salt has a saponification value of 10–140.

12. A rust-proofing oil composition for use in the surface treatment of steel sheets comprising at least one of a mineral oil and a synthetic oil as a base oil having a kinematic viscosity at 40° C. in the range of 5–50 cSt, (A) at least one of an ester sulfide and a fat sulfide in an amount of 2–15 parts by weight per 100 parts by weight of said base oil and (B) a metallic sulfonate in an amount of 2–15 parts by weight per 100 parts by weight of said base oil.

13. A rust-proofing oil composition as claimed in claim 12 wherein said metallic sulfonate is a salt derived from a sulfonic acid and a metal.

14. A rust-proofing oil composition as claimed in claim 13 wherein said sulfonic acid is selected from the group consisting of petroleum sulfonic acid, dinonylnaphthalene sulfonic acid and alkylbenzene sulfonic acid.

15. A rust-proofing oil composition as claimed in claim 13 wherein said metal is selected from the group consisting of lithium, sodium, potassium, magnesium, calcium, barium and zinc.

16. A rust-proofing oil composition for use in the surface treatment of steel sheets comprising at least one of a mineral oil and a synthetic oil as a base oil having a kinematic viscosity at 40° C. in the range of 5–50 cSt, A) at least one of an ester sulfide and a fat sulfide in an amount of 2–15 parts by weight per 100 parts by weight of said base oil;

B) a metallic sulfonate in an amount of 2–15 parts by weight per 100 parts by weight of said base oil and C) a metallic soap in an amount of 2–15 parts by weight per 100 parts by weight of said base oil.

17. The composition as claimed in claim 12 wherein said ester sulfide is the reaction product resulting from reacting an ester of a carboxylic acid with a sulfur compound, said carboxylic acid being derived from an animal fat or an oil which is a member selected from the group consisting of fish oil, tallow, lard, sperm oil, tall oil, linseed oil, olive oil, soybean oil, rapeseed oil, castor oil, peanut oil and rice bran oil.

18. The composition as claimed in claim 12 wherein said ester sulfide is the reaction product resulting from reacting an ester of a carboxylic acid with a sulfur compound, said carboxylic acid being derived from an animal fat or an oil which is a member selected from the group consisting of fish oil, tallow, lard, sperm oil, tall oil, linseed oil, olive oil, soybean oil, rapeseed oil, castor oil, peanut oil and rice bran oil.

* * * * *